United States Patent [19]

Fisher

[11] Patent Number: 4,940,026

[45] Date of Patent: Jul. 10, 1990

[54] INTERNAL COMBUSTION ENGINE WITH BALANCING FORCES

[76] Inventor: Martin A. Fisher, 8308 S.W. 103rd Ave., Miami, Fla. 33173

[21] Appl. No.: 275,904

[22] Filed: Nov. 25, 1988

Related U.S. Application Data

[63] Continuation-in-part of Ser. No. 49,308, May 13, 1987, abandoned.

[51] Int. Cl.[5] ..... F02B 75/06

[52] U.S. Cl. ..... 123/53 R; 123/192 B

[58] Field of Search ..... 123/192 B, 53 R, 53 A, 123/53 B

[56] References Cited

U.S. PATENT DOCUMENTS

| | | | |
|---|---|---|---|
| 1,410,019 | 3/1922 | Krause | 123/192 B |
| 2,117,700 | 5/1938 | Burkhardt | 123/192 B |
| 3,402,707 | 9/1968 | Heron | 123/192 B |
| 3,474,768 | 10/1969 | Anesetti | 123/192 B |
| 3,859,966 | 1/1975 | Braun | 123/192 B |
| 4,331,111 | 5/1982 | Bennett | 123/192 B |

FOREIGN PATENT DOCUMENTS

| | | | |
|---|---|---|---|
| 886890 | 11/1971 | Canada | 123/192 B |
| 2604122 | 12/1976 | Fed. Rep. of Germany | 123/192 B |
| 3120190 | 5/1982 | Fed. Rep. of Germany | 123/192 B |
| 337562 | 4/1904 | France | 123/192 B |
| 1210247 | 10/1970 | United Kingdom | 123/192 B |

*Primary Examiner*—David A. Okonsky
*Attorney, Agent, or Firm*—Malloy & Malloy

[57] ABSTRACT

An internal combustion engine of the opposed cylinder type wherein piston and cylinder assemblies are located in directly opposed relation to one another such that vibration is significantly reduced or eliminated due to the placement, weight, volumetric displacement, etc. being equal in the piston and cylinder assembly even though the size and/or number of the specifically structured piston and cylinder assemblies may vary.

15 Claims, 1 Drawing Sheet

INTERNAL COMBUSTION ENGINE WITH BALANCING FORCES

BACKGROUND OF THE INVENTION

This is a continuation-in-part application of pending U.S. Pat. application Ser. No. 049,308 filed May 13, 1987 and now abandoned.

FIELD OF THE INVENTION

This invention relates to internal combustion engines and more specifically to the flat opposed-cylinder type of engines which may operate either on a two cycle or four cycle basis and being specifically structured such that equal power strokes are delivered to the crankshaft in aligned and simultaneous, opposite directions so as to provide substantially dynamic balance to the crankshaft when such opposed and balance power strokes are delivered.

DESCRIPTION OF THE PRIOR ART

Flat, opposed-cylinder internal combustion engines have been known for some time and were considered a major design improvement to effect smoothness in operation. Known automobiles which have incorporated such an engine type include the Volkeswagon, Porcshe Design, the Lycomings and Continentals, Onans and Wisconsins. The progress in the design of engines of this type has obtained a certain smoothness and operation by alternating the firing order on opposite sides of the crankshaft. Also, the number of piston and cylinder assemblies used to drive the crankshaft have been increased to accomplish more pulses per cycle thereby also adding to the smoothness of operation. Alternately, some prior art design have demonstrated that the next opposing piston and cylinders fire simultaneously reducing the number of pulses per cycle, but generally these designs have more vibration linearly on the crankshaft as well as torque and an overall increase in vibration.

Existing U.S. Patents relating to this subject include Barkeij, 2,287,224; disclosing an internal combustion engine wherein the planes of two cylinder blocks are offset from the axis of the crankshaft in equal amount and in such a way that the connecting rods approach the axis of the cylinders on the side of the cylinders where the crankshaft is offset therefrom.

Ziegler, 3,605,705; discloses an opposed piston multicylinder internal combustion engine having a crankcase generally in the form of a square prism with two crankcase sections which are cast from the same mold and which abut along a diagonal interface extending through the axis of rotation of the crankshaft. Pairs of oppositely acting pistons are arranged around the four faces of the prism and the pistons reciprocate in the respective cylinders which are secured to the crankcase faces.

The patent to De Waern, 2,406,491; discloses an internal combustion engine with at least one combustion chamber wherein cooperatively acting pistons are not balanced in weight or displacement volume in the accompanying cylinders.

The patent to Nakagawa, 4,429,668; discloses a two cycle opposed cylinder internal combustion engine for simultaneously ignition for portable machines such as grass trimmers or the like. While the pistons are in fact disposed in opposed relation, the power stroke delivered from the pistons, upon firing, strikes the crankshaft in a different linear plane. Accordingly, there is still a need in the internal combustion engine field for an engine design having opposed piston and cylinder arranged, structured and dimensioned to deliver a balanced power stroke, preferably simultaneously, such that the pistons deliver the power stroke in a truly diametrically opposed manner thereby providing a balanced effect resulting in a substantially vibration free running of the subject engine at virtually all speeds.

SUMMARY OF THE INVENTION

The present invention is directed towards an opposed type internal combustion engine wherein at least one set of pistons are connected in diametrically opposed relation to one another so as to deliver a power stroke, simultaneously, to the crankshaft in opposite directions thereby providing a balanced force and significantly reducing or eliminating vibration regardless of the operating speed of the engine. The "balance" effect as set forth above is also attributed to the fact that the weight and volumetric displacement of the piston and cylinders on one side of the crankshaft is equal to the weight and displacement of the piston and cylinders on the opposite side of the crankshaft even though the number of pistons and accompanying cylinders may in fact vary.

One embodiment of the present invention to be described in greater detail hereinafter includes the one set of pistons comprising a first piston and cylinder assembly mounted on one side of the crankshaft and a second and third piston and cylinder assembly mounted on the opposite side of the crankshaft. Each of the second and third pistons are equal to one another in weight and configuration and each of these pistons are equal to ½ of the piston of the first piston and cylinder assembly. Similarly, the volumetric displacement of the first piston and cylinder assembly is equal to the total volumetric displacement in both the second and third piston and cylinder assemblies on the opposite side of the crankshaft. It is of further importance to note that all three piston and cylinder assemblies in the aforementioned one set of pistons fire simultaneously such that delivery of driving force to the crankshaft during the power stroke of all three piston and cylinder assemblies is balanced and equal.

Another embodiment of the present invention shows one set of pistons being defined by two piston and cylinder assemblies on one side of the crankshaft and two equally dimensioned and configured piston and cylinder assemblies mounted on the opposite side of the crankshaft wherein all four piston and cylinder assemblies are fired simultaneously and further wherein the weight and volumetric displacement of the piston and cylinder assemblies on one side of the crankshaft are equal to the weight and displacement of the piston and cylinder assemblies on the opposite side of the crankshaft. In the later embodiment, two pistons on one side of the crankshaft are disposed in substantially adjacent side-by-side relation wherein the two pistons on the opposite side of the crankshaft are disposed in a "straddling" position spaced outwardly along the length of the crankshaft in equal spaced-apart relation to opposing pistons on the opposite side of the crankshaft.

Yet another embodiment of the present invention contemplates that more than one set of pistons may be drivingly connected to the crankshaft along the length thereof. In such an embodiment, all the pistons of a given set of pistons fire simultaneously and are of balanced, offset and opposing weight, volumetric displacement, etc. In addition, the pistons of one set while firing simultaneously to one another, fire alternately in regard to the firing of the second or other set of pistons spaced along the length of the crankshaft.

It is therefore an object of the present invention to provide an engine with all the qualities of the present day opposed-type engines but with a cam shaft design and piston size and arrangement enabling the straddling configuration of one group of pistons relative to the opposing piston or pistons and wherein each of the pistons fire simultaneously of a given set producing what may be considered a canceling of forces exerted on the crankshaft. The aforementioned canceling of forces is significant from the stand-point of eliminating or significantly reducing vibration.

It is a further object of the present invention to provide a power source in the form of an internal combustion engine that when mounted on a boat or aircraft will provide a "feel" more near to a turbine or electric motor due to the elimination or reduction of vibration but yet be comparably less expensive.

It is still a further object of the present invention to provide a power source in the form of an internal combustion engine for vehicles of all types which eliminate the vibration in the vehicle components including the seats, handle bars, steering wheels, etc. normally transmitted to these components during the power strokes of the engines presently in use.

It is still a further object of the present invention to make a simple rearrangement of the mechanics of opposed internal combustion engine without introducing counter weights, additional shaft or gearing to effect the desired smoothness.

The invention accordingly comprises the features of construction, a combination of elements, an arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 1:
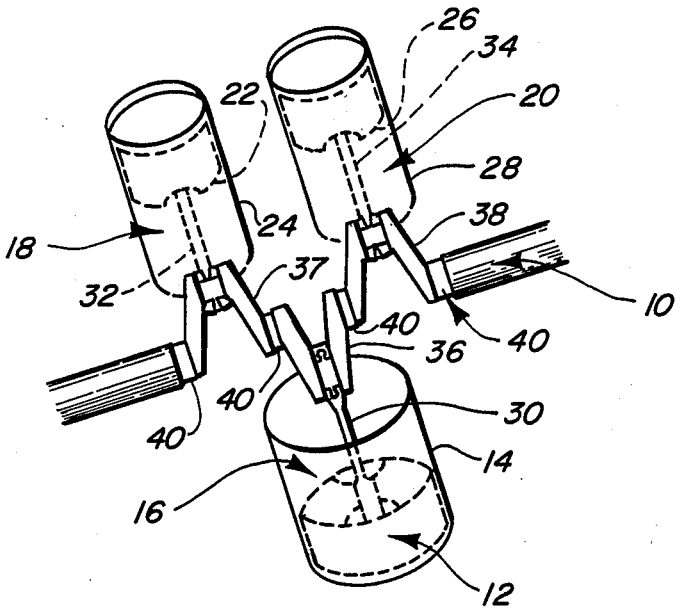
FIG. 1 is a perspective view in schematic form of a plurality of opposed piston and cylinder assemblies of one set of pistons each drivingly connected to a crankshaft.

One preferred embodiment of the present invention is shown in FIG. 1 and comprises one set of pistons drivingly connected to a crankshaft 10. More specifically, the one set of pistons comprises a first piston 12 and accompanying cylinder 14 in which it is reciprocally mounted to define a first piston and cylinder assembly generally indicated as 16. A second and third piston and cylinder assembly 18 and 20 respectively are disposed on the opposite side of the crankshaft and drivingly connected thereto so as to force driving rotation of the crankshaft 10 during the power stroke of each of the pistons. The second piston and cylinder 18 includes a piston 22 reciprocally mounted within a cylinder 24. Similarly, a third piston and cylinder assembly 20 includes a piston 26 reciprocally mounted within a cylinder 28. Each of the pistons 12, 22 and 26 include connecting rods 30, 32 and 34 respectively which are movably connected to the respective pistons 12, 22 and 26 and at their opposite end are connected to three crank structures 36, 37 and 38. The crank structures 36, 37 and 38 interconnect the respective connecting rods of the respective pistons to the crankshaft 10 to accomplish rotation thereof. An important feature of the present invention is the diametrically opposed disposition of the first piston 12 to the second and third pistons 22 and 26 such that forces exerted on the crankshaft during the power stroke of each of the pistons are effectively offset or balanced which has the effect of reducing vibration during the operation of the subject internal combustion engine regardless of the operating speed. Another important feature of the present invention is the fact that the weight of each of the pistons 22 and 26 is ½ the weight of the piston 12. Similarly, the collected weight of connecting rods 32 and 34 and cranks 37 and 38 are equal to the weight of the connecting rod 30 and crank 36. Also, the combined longitudinal dimension of the connecting rod 30 and accompanying crank structure 36 is equal to each of the longitudinal dimensions of the respective connecting rods 32 and crank 37 and connecting rod 34 and accompanying crank 38. Finally, the volumetric displacement of the cylinders 24 and 28 are equal to the total of volumetric displacement of the cylinder 14. All of the above factors, plus the included simultaneous firing of all three pistons of the one set as shown in FIG. 1 will result in a balance of dynamic forces exerted on the crankshaft 10 during the power stroke of each of the pistons.

An ignition system is also of course intended to accompany the subject internal combustion engine and the ignition system can be of any conventional type except that the contact arms and points as well as the breaker points are directed to the opposite cylinders at the same time to accomplish proper timing in the provision of simultaneous firing of all first, second and third piston and cylinder assemblies 16, 18 and 20.

Other structural features as disclosed in FIG. 1 include bearing structures 40 provided for rotational support of the crankshaft 10. Obviously, the type and positioning of the bearing structures 40 may of course vary.

Figure 2:
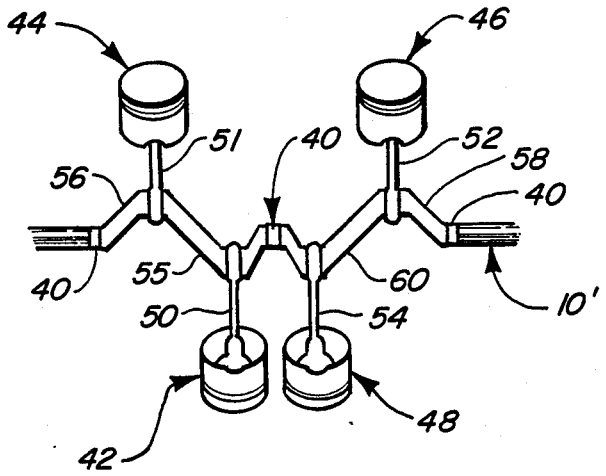
FIG. 2 is a perspective view in schematic of another embodiment of the present invention showing a different number and size of pistons still operating within the intended scope of the present invention.

Another embodiment of the present invention is shown in FIG. 2 wherein one set of pistons comprises a first, second, third and fourth piston and cylinder assemblies 42, 44, 46 and 48. For purposes of clarity, it should be assumed that each of the pistons of course are reciprocally mounted within an independent cylinder. However, such cylinders are not specifically shown in detail. Also, the ignition system associated with each of the embodiments of FIGS. 1 and 2, as set forth above, may be of conventional design and specifically structured to accomplish simultaneous firings of all pistons resulting in a simultaneous power stroke from all pistons being delivered to the crankshaft 10'. In the embodiment shown in FIG. 2 the first and fourth pistons 42 and 48 are located on one side of the crankshaft wherein the second and third pistons 44 and 46 are located in directly opposite relation thereto on the opposite side of the crankshaft 10'. Further with regard to both FIGS. 1 and 2, the one piston and cylinder assembly, 16 in FIG.

1 and 42 and 48 in FIG. 2, are located inwardly of the two outer spaced apart piston and cylinder assemblies of the respective embodiments. This provides what may be referred to as a "straddling" effect wherein the respective dispositions of the respective pistons are provided again to increase the balanced effect in delivering the power to the crankshaft 10'.

In the embodiment of FIG. 2, the pistons 42 and 48 are equal in weight and displacement to the pistons 44 and 46 on the opposite side of the crankshaft 10. As set forth above, the specific cylinders are not shown but the volumetric displacement of each of the cylinders are in fact equal. The associated connecting rods 50, 51, 52 and 54 are provided to interconnect the respective pistons to the crank structures 55, 56, 58 and 60. Accordingly, driving rotational force is delivered to the crankshaft 10'. As in FIG. 1, the collective longitudinal dimension of the cooperative connecting rods and crank structures associated with each piston are equal in order to make the stroke the same.

Yet another embodiment associated with each of the FIGS. 1 and 2, include a second set of piston and cylinder assemblies located in spaced relation to the respective sets of pistons shown in FIGS. 1 and 2. In each embodiment, the second set of pistons are spaced along the length of the crankshaft and are opposed similar to that with regard to FIGS. 1 and 2. The difference being when two sets of pistons are mounted concurrently on the same crankshaft is that one set of pistons will each fire simultaneously with one another and alternately with the firing of the pistons in the second set. The same balance of force will thereby result.

Now that the invention has been described, what is claimed is:

1. An internal combustion engine of the opposed cylinder type comprising:

(a) a crankshaft and at least one set of pistons movably connected thereto, each piston of said one set reciprocally mounted within a separate corresponding cylinder and rotatably drive said crankshaft during a power stroke thereof, (b) said one set of pistons including at least a first piston and cylinder assembly mounted on one side of said crankshaft and at least a second and a third piston and cylinder assembly mounted on the other side of said crankshaft in directly opposed relation to said first piston and cylinder assembly, (c) each of said cylinders of said second and third piston and cylinder assemblies comprising one half the displacement volume of said cylinder of said first piston and cylinder assembly, (d) whereby vibration of the engine is substantially reduced at all running speeds.

2. An assembly as in claim 1 wherein said first piston and cylinder assembly is connected to said crankshaft between said second and third piston and cylinder assemblies at a substantially equally spaced distance therebetween.

3. An assembly as in claim 2 wherein each piston of said second and third piston and cylinder assemblies is equal to ½ the weight of said first piston and cylinder assembly and crank throw or structure.

4. An engine as in claim 1 wherein each piston of said first, second and third piston and cylinder assemblies includes a connecting rod attached thereto and a crank structure interconnecting said connecting rod to said crankshaft.

5. An engine as in claim 4 wherein said piston, connecting rod and crank structure of each of said first and second piston and cylinder assemblies are equal to ½ the weight of said piston, connecting rod and crank structure of said first piston and cylinder assembly.

6. An engine as in claim 4 wherein said connecting rod and crank structure of each of said first, second and third piston and cylinder structures have a substantially equal collective longitudinal dimension.

7. An engine as in claim 1 further comprising a second set of pistons movably connected to said crankshaft and spaced distance along the length thereof from said one set of pistons, each piston of said second set movably connected to said crankshaft and reciprocally mounted within a separate corresponding cylinder, said second set of pistons including at least a first piston assembly mounted on one side of said crankshaft and at least a second and third piston and cylinder assembly mounted on the other side of said crankshaft in opposed relation to said first piston and cylinder assembly, each of said cylinders of said second and third piston and cylinder assemblies comprising ½ the displacement volume of said cylinder of said first piston and cylinder assembly, said piston and cylinder assemblies of said second set of pistons interconnected to said ignition mean to fire simultaneously; said piston and cylinder assemblies of said one set of pistons firing alternately with said piston and cylinder assemblies of said second set of pistons.

8. An internal combustion engine of the opposed cylinder type comprising:

(a) a crankshaft and at least one set of pistons movably connected thereto, each piston of said one set reciprocally mounted within a separate corresponding cylinder and rotatably driving said crankshaft during a power stroke thereof, (b) said one set of pistons including at least a first piston and cylinder assembly and a fourth piston and cylinder assembly mounted on one side of said crankshaft and at least a second and a third piston and cylinder assembly mounted on the other side of said crankshaft in opposed relation to said first and fourth piston and cylinder assembly, (c) each of said cylinders of said second and third piston and cylinder assemblies comprising an equal displacement volume with said cylinder of said first and fourth piston and cylinder assemblies, (d) said first and fourth piston and cylinder assemblies and said second and third piston and cylinder assemblies interconnected to an ignition means to fire simultaneously and thereby provide equal and opposite driving force to said crankshaft, (e) whereby vibration of the engine is substantially reduced at all running speeds.

9. An engine as in claim 8 wherein said first and fourth piston and cylinder assemblies are connected to said crankshaft between said second and third piston and cylinder assemblies at a substantially equally spaced distance therebetween.

10. An engine as in claim 9 wherein said pistons of said second and third piston and cylinder assembly are equal in weight to the piston of said first and fourth piston and cylinder assembly.

11. An engine as in claim 8 wherein each piston of said first, second, third and fourth piston and cylinder assemblies includes a connecting rod attached thereto and a crank structure interconnecting said connecting rod to said crankshaft.

12. An engine as in claim 11 wherein said piston, connecting rod and crank structure of said first and second piston and cylinder assemblies is equal to the weight of said piston, connecting rod and crank structure of said second and fourth piston and cylinder assemblies.

13. An engine as in claim 11 wherein said connecting rods and crank structure of said first, second, third and fourth piston and cylinder assemblies have a substantially equal collected longitudinal dimension.

14. An internal combustion opposed flat type engine comprising sets of cylinders which oppose each other in such a manner that a full-sized power chamber is opposed and aligned on a crankshaft between a pair of half-sized power chambers, all three of which fire together providing internal forces equal and opposite so as to eliminate any vibration and provide smooth running at all speeds.

15. An engine as in claim 1 wherein said first and said second and third piston and cylinder assemblies interconnected to an ignition means to fire simultaneously and thereby provide equal and opposite driving force to the crankshaft.

* * * * *